US006902520B2

(12) United States Patent
Beck et al.

(10) Patent No.: US 6,902,520 B2
(45) Date of Patent: Jun. 7, 2005

(54) FOLDING MACHINE HAVING AT LEAST ONE PAIR OF KNIFE SHAFTS

(75) Inventors: Christoph Beck, Spiegelberg (DE); Eberhard Krieger, Weinstadt-Stuempfelbach (DE); Bodo Tegtmeier, Alfdorf-Phahlbronn (DE); Georg Dannemann, Backnang (DE)

(73) Assignee: Maschinenbau Oppenweiler Binder GmbH & Co. KG, Oppenweiler (DE)

( * ) Notice: Subject to any disclaimer, the term of this patent is extended or adjusted under 35 U.S.C. 154(b) by 0 days.

(21) Appl. No.: 10/792,773

(22) Filed: Mar. 5, 2004

(65) Prior Publication Data

US 2004/0214709 A1 Oct. 28, 2004

(30) Foreign Application Priority Data

May 8, 2003 (EP) ..... 03010428

(51) Int. Cl.[7] ..... B31B 1/28
(52) U.S. Cl. ..... 493/475; 493/478
(58) Field of Search ..... 493/475, 476, 493/478, 479

(56) References Cited

U.S. PATENT DOCUMENTS 4,023,790 A 5/1977 Gortowski
4,565,046 A * 1/1986 Stumpf ..... 53/114
5,391,138 A 2/1995 Abramson et al.
5,657,529 A * 8/1997 Bohn et al. ..... 29/563
5,840,003 A * 11/1998 Meetze et al. ..... 493/405
6,245,004 B1 * 6/2001 Waters ..... 493/61
6,422,552 B1 * 7/2002 Chesno et al. ..... 270/32
6,457,300 B1 * 10/2002 Yang ..... 53/550
6,702,728 B1 * 3/2004 Ballos, III ..... 493/116
6,726,616 B2 * 4/2004 Militzer et al. ..... 493/424

FOREIGN PATENT DOCUMENTS

DE 30 25 239 A1 1/1982

* cited by examiner

*Primary Examiner*—Eugene Kim
(74) *Attorney, Agent, or Firm*—Rothwell, Figg, Ernst & Manbeck, PC

(57) ABSTRACT

The folding machine includes at least one pair of knife shafts, the knife shafts (22, 24) of which are, in a working position, mounted parallel to each other between two spaced-apart side walls (18, 20) of the folding machine (10). In order, in parallel with the production process, to be able to prepare knife shafts for a subsequent production process, the knife shafts (22, 24) are mounted in a cassette (28) which can be displaced through a sidewall (20) facing the operator from an inserted position, in which the knife shafts (22, 24) are in their working position, into a pull-out position, in which the knife shafts (22, 24) are outside the folding machine (10).

6 Claims, 4 Drawing Sheets

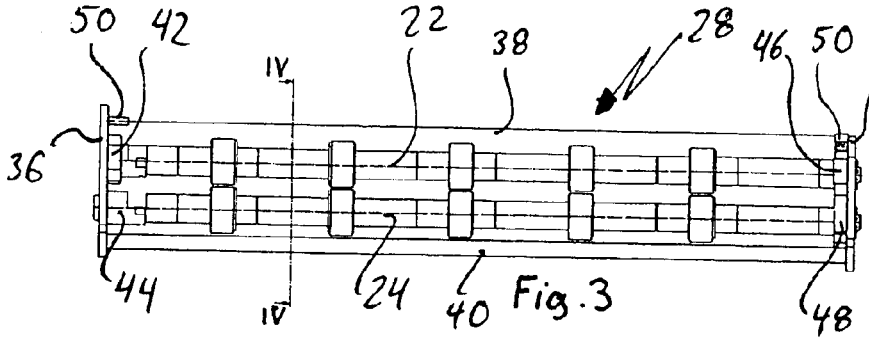
Fig. 3
Fig. 4
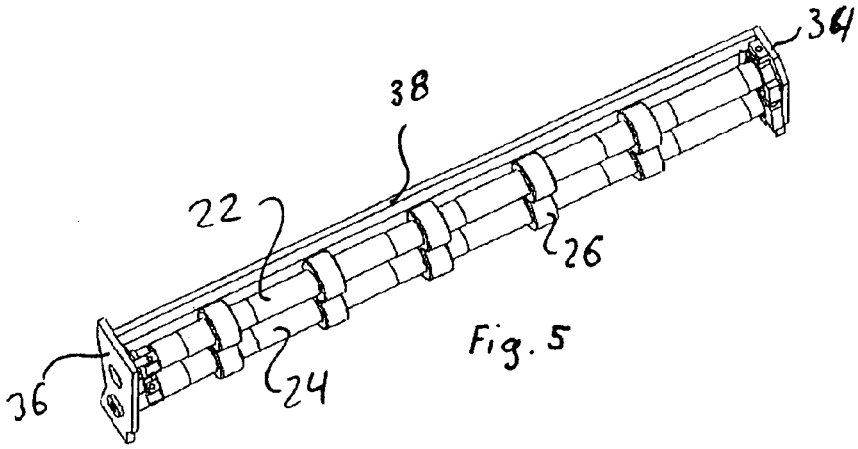
Fig. 5

FOLDING MACHINE HAVING AT LEAST ONE PAIR OF KNIFE SHAFTS

BACKGROUND OF THE INVENTION

1. Field of the Invention

The invention relates to a folding machine having at least one pair of knife shafts, the knife shafts of which are, in a working position, mounted parallel to each other between two spaced-apart side walls of the folding machine.

2. Description of the Background Art

In order to be able to cut, cut out, perforate, crimp etc. folded paper sheets perpendicular to a fold, i.e. in the running direction of the sheets, pairs of knife shafts are provided upstream and downstream of the folding rollers of a folding unit. These generally concern pairs of knife shafts in which one knife shaft is fitted with upper knife tools and the other knife shaft is fitted with lower knife tools, said tools being arranged on a tool holder fitted on the knife shaft. The knife shafts are fitted with appropriate tools depending on the requirements of the task. A corresponding folding machine is disclosed, for example, in DE 30 25 239 C2. In the case of the known folding machines, the knife shafts are usually mounted on the side walls of the folding machine. For this reason, they can be removed only if the folding machine is at a standstill. For this purpose, it is generally necessary first of all to pull out the buckle plates. After their fastening has been released, the knife shafts then have to be lifted out over the side walls of the machine. Since the knife shafts are generally very heavy, this work is very laborious. Finally, the knife shafts can only be set in a precise manner when they are installed in the folding machine. For this purpose, auxiliary means are fitted in the direct vicinity of the knife shafts. These are, for example, rulers having a tape measure printed on them enabling the position of the tool to be read.

SUMMARY OF THE INVENTION

The invention is based on the object of providing, with structurally simple means, a folding machine in which rapid changing of the knife shafts is possible in a simple manner.

This object is achieved by a folding machine comprising at least one pair of knife shafts which are, in a working position, mounted parallel to each other between two spaced-apart side walls of said folding machine, wherein said knife shafts are mounted in a cassette which is displaceable through a sidewall facing an operator from an inserted position, in which said knife shafts are in an working position thereof, into a pull-out position, in which said knife shafts are located outside said folding machine.

Since the knife shafts are mounted in the cassette which can be displaced through the sidewall from the inserted position into the pull-out position, changing of the knife shafts is possible without removal of the buckle plates of a folding unit connected upstream. In addition, it is possible to preset a pair of knife shafts while the folding machine is running, as a result of which the set-up time can be substantially reduced.

The cassette is preferably arranged in a drawer which can be inserted and pulled out through the side wall. When the drawer is pulled out, the cassette can be removed and a new cassette placed into the drawer. After the drawer has been inserted, the changing of the pair of knife shafts is complete.

In one particular embodiment, the cassette has an end wall facing the drive and an end wall facing the operator, said walls being spaced apart and being connected to each other by a crosspiece. The knife shafts are mounted on the end by bearing devices.

The bearing devices of at least one knife shaft can preferably be adjusted in order to set the nip between the knife shafts. This adjusting device is part of the knife shaft cassette. The adjustment may take place outside the folding machine.

For a rapid connection to the drive facing the folding machine, the bearing devices facing the drive can be mounted rotatably in the end wall facing the drive, and pass through said end wall.

In order to center the cassette, it is advantageous if a respective fixing pin is fitted on the two end walls and, in the inserted position, engages in a centering opening in the respective side wall of the folding machine.

A precise setting of knife holders on the knife shafts can be achieved by the fact that a scale is provided on the knife shaft, said scale preferably being engraved in it.

Since the setting of the knife holders on the knife shafts can take place outside the machine, the operator can stand directly in front of the knife shaft cassette during the tool change, so that parallax errors do not occur.

BRIEF DESCRIPTION OF THE INVENTION

An exemplary embodiment of the invention will be explained in greater detail below with reference to drawings, in which:

FIG. 3 shows a cassette in which a pair of knife shafts is fitted,

FIG. 4 shows the section IV—IV of FIG. 3,

FIG. 5 shows a perspective view of the cassette,

DETAILED DESCRIPTION OF THE INVENTION

Figure 1:
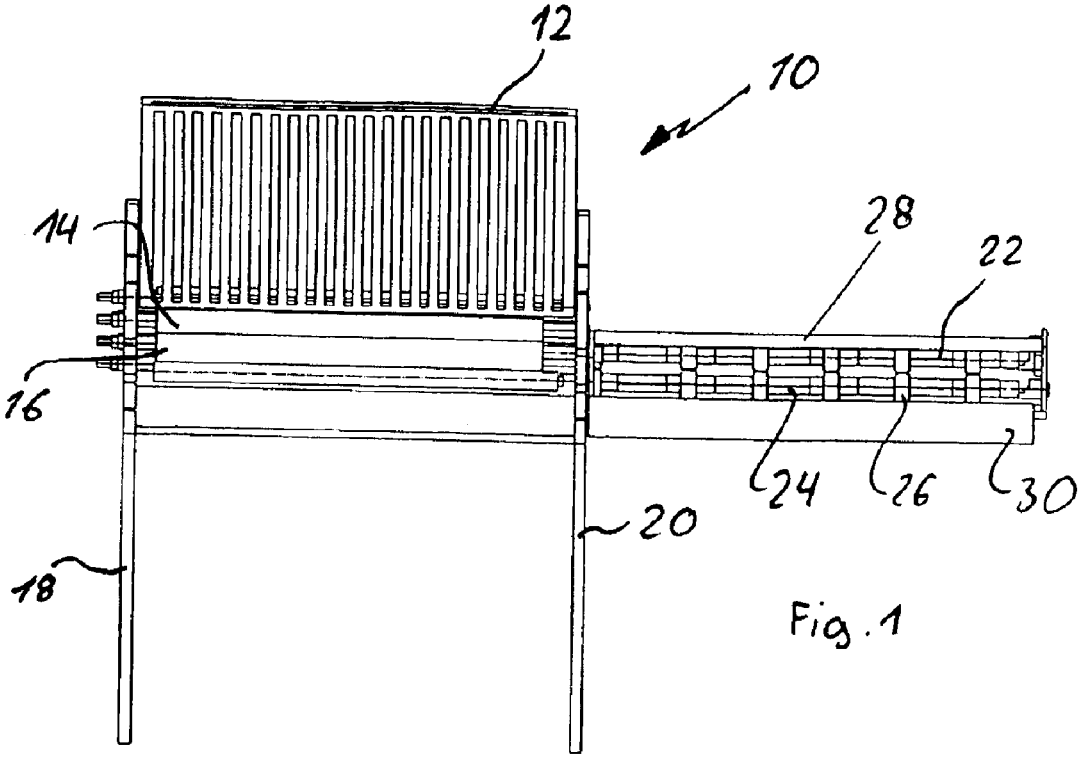
FIG. 1 shows a folding machine with a pulled-out cassette.
Figure 2:
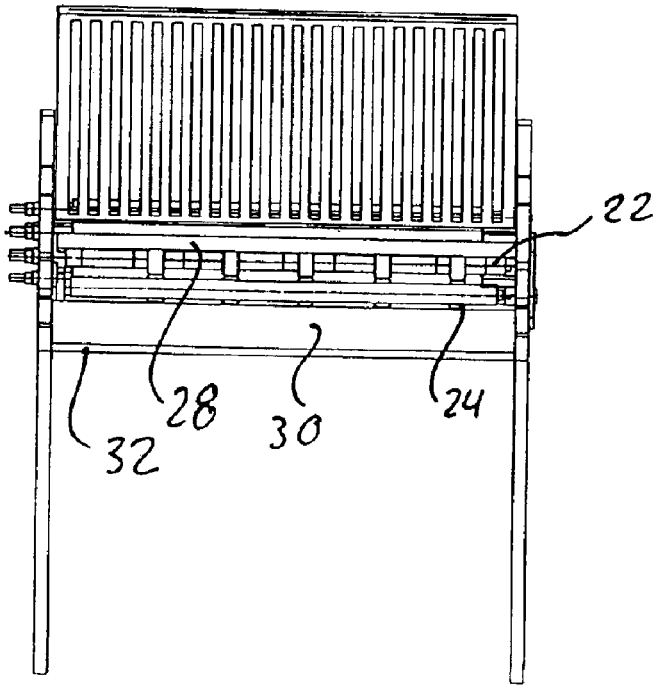
FIG. 2 shows the folding machine of FIG. 1 with an inserted cassette.

The folding machine 10 shown in FIGS. 1 and 2 has a buckle-plate folding unit having a buckle plate 12, downstream of which, in the running direction of the sheets, are arranged folding rollers 14, 16 which are mounted in a sidewall 18 facing the drive and a sidewall 20 facing the operator. As can be seen in FIG. 2, a pair of knife shafts comprising an upper knife shaft 22 and a lower knife shaft 24 is arranged downstream of the folding rollers 14, 16 in the running direction of the sheets. Five knife holders 26 are arranged at equal spacing, as seen in the longitudinal direction, on the knife shafts 22, 24 and on them tools (not shown) for cutting, cutting out, perforating, crimping etc. a sheet leaving the buckle plate 12 are arranged. The knife shafts 22, 24 are mounted in a cassette 28, the design of which will be explained in greater detail below. The cassette 28 itself is arranged on a drawer 30 which can be pulled out of the folding machine 10 through an opening in the sidewall 20 facing the operator until the entire cassette 28 is outside the folding machine 10. This position is shown in FIG. 1.

FIG. 2 shows the position of the drawer 30 in which it is inserted completely into the folding machine 10. In this case, the drawer 30 bears with its end wall 34 facing the drive against the sidewall 18 facing the drive. The drawer 30 extends completely between the two side walls 18, 20. The drawer 30 rests on a horizontal base 32 which extends between the side walls 18, 20. To guide the movement of the drawer 30 from the inserted position into the pulled-out position, guide means (not shown) are provided which guide the drawer 30 in such a manner that it executes a rectilinear movement. As such a guide for a drawer 30, use can be made, for example, of two three-part telescopic guides which are connected to one another by a drawer base and, in the inserted state, are arranged completely between the machine side walls. The cassette 28 is inserted loosely into the drawer 30.

The cassette 28 with the knife shafts 22, 24 arranged parallel to each other on it is shown in greater detail in FIGS. 3 to 5, 8 and 9. The cassette 28 has an end wall 34 facing the drive and an end wall 36 facing the operator, said end walls being connected to each other by crosspieces 38, 40. The two knife shafts 22, 24 are mounted rotatably, for example via plug-in spindles or half-shells, in knife shaft mountings 42, 44 on the operator side. The upper mounting 42 can be displaced in a plane defined by the two shaft axes or is designed such that it can be rotated about an eccentric point in order to make it possible to set the nip between the two knife shafts 22, 24.

Figure 8:
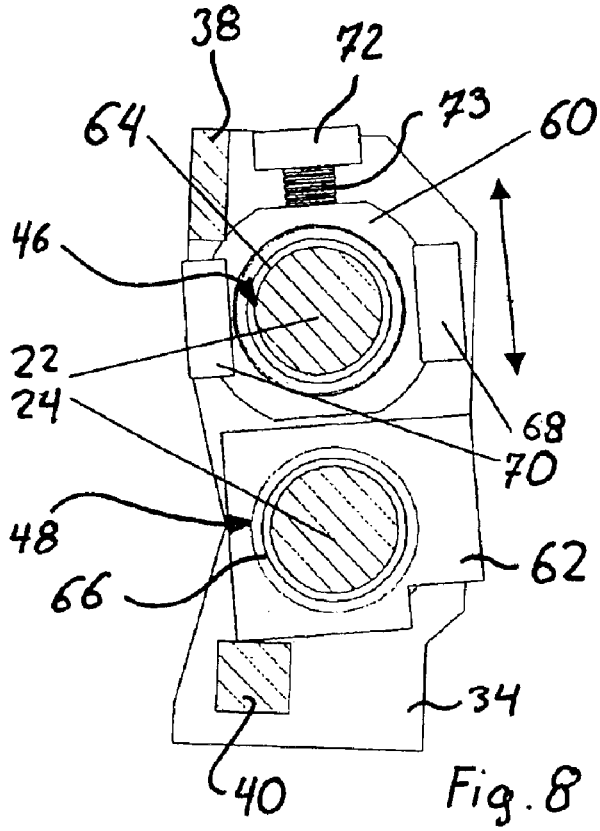
FIG. 8 shows the view of FIG. 4 on an enlarged scale.
Figure 9:
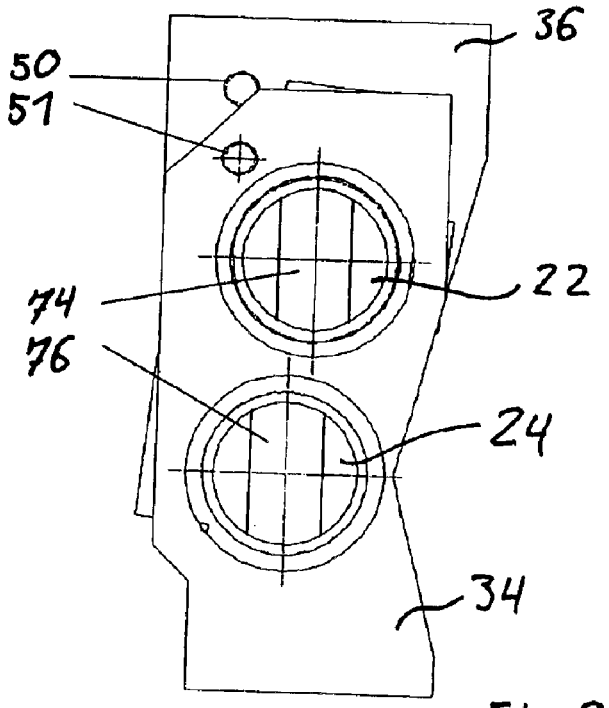
FIG. 9 shows a left side view of the cassette of FIG. 3 on an enlarged scale.

As can be seen in FIGS. 8 and 9, the knife shafts 22, 24 are mounted rotatably on the drive side by bearing devices 46, 48, the bearing devices 46, 48 being designed simultaneously as a rotary leadthrough and coupling element which are connected in a rotationally fixed manner to a drive element of the folding machine when the cassette 28 is inserted into the folding machine 10. The upper bearing device 46 can be displaced in the plane defined by the two shaft axes while the lower bearing device 48 is arranged in a fixed manner.

The upper bearing device 46 has a bearing shell 60 in which a ball bearing 64 through which the shaft 22 passes is arranged. The bearing shell is guided along a straight line, which passes through the center axes of the shafts 22, 24, through two guide blocks 68, 70 arranged on both sides. One end of a threaded pin 73 engages in the upper side of the bearing shell 60. The other end is in engagement with a threaded opening which is formed in a threaded block 72 which is fastened to the sidewall 34 adjacent to the upper edge thereof. The threaded pin 73 is accessible from above via an opening in the threaded block 72, and can be rotated by means of a suitable tool in order to set the nip between the two knife shafts 22, 24.

The lower bearing device 48 has a bearing block 62 which is fastened to the sidewall 34 and in which a ball bearing 66 through which the shaft 24 passes is arranged.

As can be seen in FIG. 9, coupling sections 74, 76 are provided at that end of the knife shafts which faces the drive, said coupling sections being used to connect the knife shafts to drive elements on the folding machine 10 when the cassette 28 is in the position shown in FIG. 2, the coupling sections 76, 78 being designed in such a manner that an axial or radial offset is compensated for and the torque is introduced in a positive-locking manner.

Above the upper knife shaft 22, a fixing pin 50 which protrudes toward the end wall 34 facing the drive is provided on the end wall 36 facing the operator. In the inserted position of the cassette 28 which is shown in FIG. 2, this fixing pin 50 engages in a centering opening in the outside of the sidewall 20. As can also be seen in FIG. 2, the end wall 36 facing the operator rests with its edge on the sidewall 20. A further fixing pin 51 extends outward from the end wall 34 facing the drive. In the inserted position of the cassette 28 shown in FIG. 2, this fixing pin 51 engages in a centering opening in the inside of the sidewall 18, as a result of which the cassette is automatically aligned.

Figure 6:
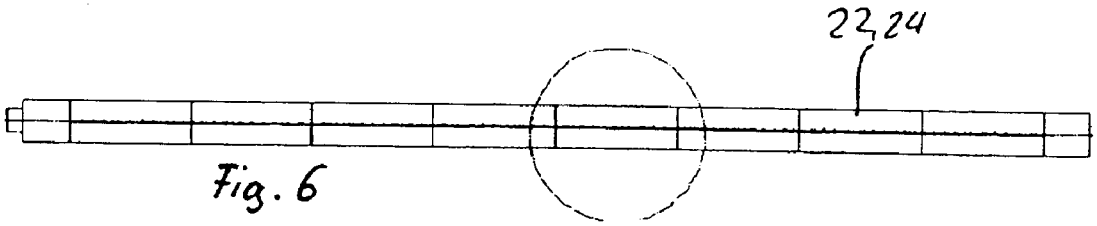
FIG. 6 shows a knife shaft on which a scale is provided.
Figure 7:
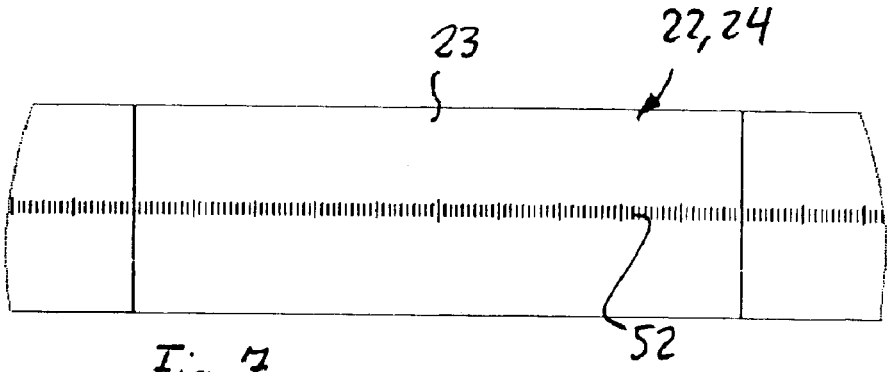
FIG. 7 shows the scale of the knife shaft in FIG. 6 on an enlarged scale.

The tool holders 26 are fitted releasably on the shaft body 23 of the knife shafts 22, 24. Precise positioning of the tool holders 26 on the knife shafts 22, 24 is made possible by a scale, as is shown in FIGS. 6 and 7. A vernier is engraved into the surface of the shaft body 23 of the knife shafts 22, 24 in the longitudinal direction of the knife shafts 22, 24 as the scale 52. Owing to the precise scale 52 directly on the knife shaft 22, 24, it is possible to fasten a tool holder 26 on the knife shaft 22, 24 in a precise manner. The fastening accuracy is additionally increased by the fact that it is possible for an operator to fasten the tool holders 26 to the knife shafts 22, 24 outside the folding machine 10. This avoids parallax errors.

What is claimed is:

1. A folding machine comprising at least one pair of knife shafts which are, in a working position, mounted parallel to each other between two spaced-apart side walls of said folding machine, wherein said knife shafts are mounted in a cassette which is displaceable through a sidewall facing an operator from an inserted position, in which said knife shafts are in an working position thereof, into a pull-out position, in which said knife shafts are located outside said folding machine wherein said cassette comprises a first end wall facing said drive and a second end wall facing said operator, said first and second end walls being spaced apart and being connected to each other by at least one crosspiece, wherein said knife shafts are mounted on said first and second end walls by means of bearing devices and wherein said bearing devices facing said drive are mounted rotatably in said end wall facing said drive, pass through said end wall and can be connected to a drive.

2. A folding machine as claimed in claim 1, wherein said cassette is arranged in a drawer which can be inserted and pulled out through said sidewall facing said operator.

3. The folding machine as claimed in claim 1, wherein said bearing devices of at least one of said knife shafts can be adjusted in order to set a nip between said knife shafts.

4. The folding machine as claimed in claims 1, wherein a respective protruding fixing pin is fitted on said end walls and, in said inserted position, engages in a centering opening in a corresponding one of said sidewalls of said folding machine.

5. The folding machine as claimed in claim 1, wherein tool holders are fastened releasably on said knife shafts and a scale extending in a longitudinal direction of said knife shafts is provided on said knife shafts.

6. The folding machine as claimed in claim 5, wherein said scale is engraved in said knife shafts.

* * * * *